United States Patent [19]

Barton et al.

[11] 4,122,771

[45] Oct. 31, 1978

[54] SQUEEGEE HOLDER

[75] Inventors: James G. Barton, San Clemente; James R. Ford, Sebastopol, both of Calif.

[73] Assignee: General Dynamics, Pomona, Calif.

[21] Appl. No.: 787,185

[22] Filed: Apr. 13, 1977

[51] Int. Cl.[2] ..... B41F 15/44

[52] U.S. Cl. ..... 101/123; 15/245; 101/124

[58] Field of Search ..... 101/123, 124; 15/236 R, 15/245, 256.5, 256.51

[56] References Cited

U.S. PATENT DOCUMENTS

| | | | |
|---|---|---|---|
| 3,483,819 | 12/1969 | Hughes, Jr. | 101/123 |
| 3,650,208 | 3/1972 | Lambert | 101/123 |
| 3,973,491 | 8/1976 | Porth et al. | 101/123 X |

*Primary Examiner*—Ronald E. Suter

*Attorney, Agent, or Firm*—Henry M. Bissell; Edwin A. Oser; Edward B. Johnson

[57] ABSTRACT

A squeegee blade for a thick film printing apparatus is held between horizontally compressing holder plates. One of the holder plates is integrally formed with a member for attachment to the pressure printing apparatus. The other holder plate attaches to the first one. The squeegee presents a sharp corner edge exposed from the holding plates and provision is made for varying the angle of attack for different inks used in the film printing process.

1 Claim, 6 Drawing Figures

SQUEEGEE HOLDER

The invention described herein was made in the course of or under a contract or subcontract thereunder with the U.S. Department of the Navy.

Background of the Invention

1. Field of the Invention

This invention relates to pressure applicators, and more particularly to pressure squeegees used in a thick film printing apparatus.

2. Description of the Prior Art

In stencil printing and silk screen printing methods, fine detail is achieved by a fine-mesh silk, steel wire gauze or plastic screen. The design is formed as a portion pervious to ink on the screen. The screen is then placed on the surface to be decorated and ink is applied to the screen by means of a squeegee. Some of the ink soaks through the pervious areas of the silk or other type screen and is printed on the surface, which may be paper, metal, wood, glass, rubber, textile fabric or the like. To obtain fine detail in the pattern, it is necessary to produce the stencil by a photographic process. Such a process is done by applying a light sensitive coating to the screen. The image is developed by washing which removes the coating from those areas where it has not been hardened by the action of light. The screen stencil process is very versatile with regard to the wide range of materials to which it can be applied. Simple designs can be made by sticking paper, celluloid or metal patterns to the screen.

It is clear that an even deposition of the ink is important. Consistent, even pressure must be applied over the entire surface area of the screen. The application of pressure through the squeegee, therefore, must be maintained carefully even, and the squeegee must be moved over the screen area smoothly, at a uniform rate of speed and with a very consistent pressure application. The structure of the holder for the squeegee, therefore, takes on increased significance inasmuch as small deviations in the pressure along the squeegee itself will produce a non-uniform image on the printed surface.

In the past, particular squeegee or wiping surface holders have been designed for particular purposes such as floor and window cleaning and the like. The structure of the wiping element has been particularly designed for holding the wiper itself, such as in the Jester U.S. Pat. No. 749,296 for a floor scrubber and the Morley U.S. Pat. No. 2,580,814 for a window wiper. It has been know to provide a squeegee blade holder for imprinting images on ceramic substrates common in the hybrid microcircuit manufacturing industry. Such a squeegee holder is shown in FIGS. 1 and 2 of the accompanying drawings, and labeled "Prior Art". Such structures, however, frequently have uneven pressure created along the longitudinal length of the squeegee itself when attached to a printer, so that bows and other irregularities result along the longitudinal length.

In the thick-film substrate manufacturing industry, a squeegee is used to force conductive and non-conductive ink through a screen and onto a ceramic substrate. The ink is oven dried and the substrate is fired in a furnace with a carefully controlled temperature profile. Subsequent processing of the substrate is then performed. The ink is usually applied in the form of a paste comprising a functional phase having powdered metal or powdered metal alloy with suitable resistive or dielectric materials introduced for resistive and dielectric purposes. The paste frequently has a binder which may be glass or occasionally a reactive oxide. The carrier is composed frequently of resins and solids. Conductive pastes that are currently used include pure gold, pure silver, pure nickel, compounds including platinum and gold; platinum, silver and gold, platinum and gold; platinum, copper, and silver; and platinum and silver. In aerospace and avionic hybrid hardware where active and passive chips are eutectically diebonded and ultrasonic or thermal compression wire bonding is used, gold is clearly the preferred conductor.

Gold, however, is a very heavy substance. Pressures used to apply a gold conductive paste, therefore, must be substantial, yet all the while consistent and even, as above. Thus, the squeegee holders of the known prior art having even the slightest bows or other pressure irregularities can seriously affect the resistive, capacitive and other electrical characteristics of a printed circuit on a ceramic substrate. It has long been sought, therefore, to provide more consistent and more even pressure on the squeegee by improving the structure holding the squeegee and indirectly applying the pressure to the squeegee and the paste itself.

SUMMARY OF THE INVENTION

In the preferred form of the invention, a squeegee holder has a single plate or attaching instrument which couples to a pressure providing instrument in the printer. The single attaching plate is integrally formed with one or two squeegee holding jaw elements applying substantially a horizontal or lateral pressure against the squeegee itself. A complemental squeegee jaw separate from the first jaw is held to the first jaw by horizontal fastening elements, such as cylindrical screws. In the preferred form of the invention, the squeegee is an elongated rubber or other resilient type material blade having substantially a square cross-section. The squeegee is held by the two jaws at a canted diagonal alignment, so that a corner edge of the squeegee is exposed beneath the jaws. In variations of the preferred embodiment, the cant of the cross-sectional alignment of the squeegee can be selected so that the angle of attack of the leading edge of the squeegee blade can be varied without changing the loads applied to the squeegee by the jaws or by the pressure instrument.

BRIEF DESCRIPTION OF THE DRAWINGS

A better understanding of the present invention may be had from a consideration of the following detailed description, taken in conjunction with the accompanying drawings, in which.

DESCRIPTION OF THE PREFERRED EMBODIMENT

Figure 1:
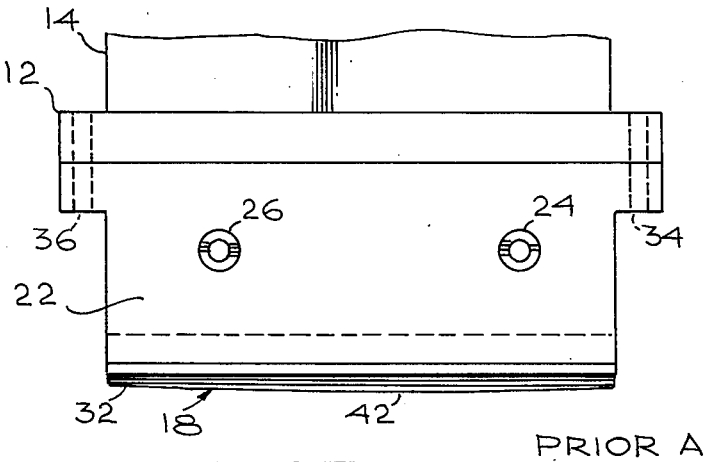
FIG. 1 is a front elevational view of a squeegee holder of the prior art.
Figure 2:
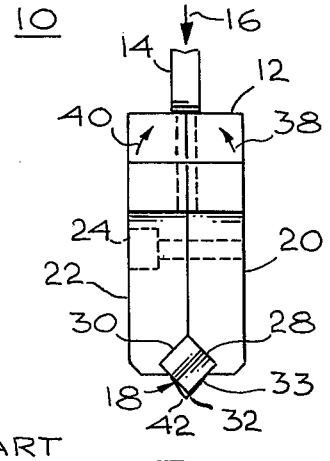
PRIOR ART Fig. 2
FIG. 2 is a side elevational view of the squeegee holder of the prior art of FIG. 1 having a pressure plate shown.

In the prior art, reference being had initially to FIGS. 1 and 2, a squeegee holder 10 was connected to a pressure plate 12 directly connected by links 14 to the pressurizing apparatus of the printing machine. Pressure is applied in the direction of the arrow 16 to force a squeegee 18 in the downward direction. The squeegee holder is comprised of two parts, a right holding plate 20 and a left holding plate 22, both being generally symmetrical mirror images of each other. Fasteners such as screws are inserted through threaded holes 24, 26 to hold the plates 20 and 22 together. The right holding plate 20 has an open, squeegee engaging or gripping jaw 28. The left holding plate 22, similarly, has a squeegee engaging jaw 30. When the holding plates 20 and 22 are held together by fasteners through the holes 24 and 26, the jaws 28, 30 engage a squeegee 18 in such a manner to allow one corner edge 32 of the squeegee 18 to protrude from the holding arrangement 10.

The holding arrangement 10 is secured to the plate 12 again by fasteners such as cylindrical screws through holes 34 and 36. Conventionally, the holes 34 and 36 are formed by semi-cylindrical cuts from the facing sides of the holding plates 20 and 22. In practice when pressure is applied through screws at holes 34 and 36 to secure the holder to the plate 12, the force transmitted to the squeegee 18 through the fasteners to the joined holding plates 20 and 22 causes a distortion of the squeegee in the form of a bulge 42 (exaggerated for purposes of illustration).

In operation, pressure is applied in the direction of arrow 16 through the connecting links 14 onto holding plate 12. Holding plate 12 then applies pressure against the squeegee holder 10 so that the wiping side 33 will be pressurized against a wire screen or the like. A reactive pressure, of course, is felt through the squeegee 18 and communicated to the holding plates 20 and 22. The reactive pressure in right holding plate 20 is not only upward, but by virtue of the diagonal or canted angle of the squeegee 18, an outward or horizontal pressure is felt. The pressure thus applied by the right holding plate 20 to the plate 12 is in a counter-clockwise direction as indicated by the arrow 38. Conversely, the pressure resulting from this horizontal reaction pressure in holding plate 22 is in the clockwise direction as indicated by arrow 40. These pressures are both applied to the pressure holding plate 12 and create an instability in the application of the pressure through the squeegee 18. Moreover, this uneven pressure applied to the squeegee 18 combined with the pressure of the fasteners through the holes 24 and 26 contribute to the bow or bulge 42 in the center of the elongated squeegee 18. This has caused uneven printing and has resulted in poor production yields.

Figure 3:
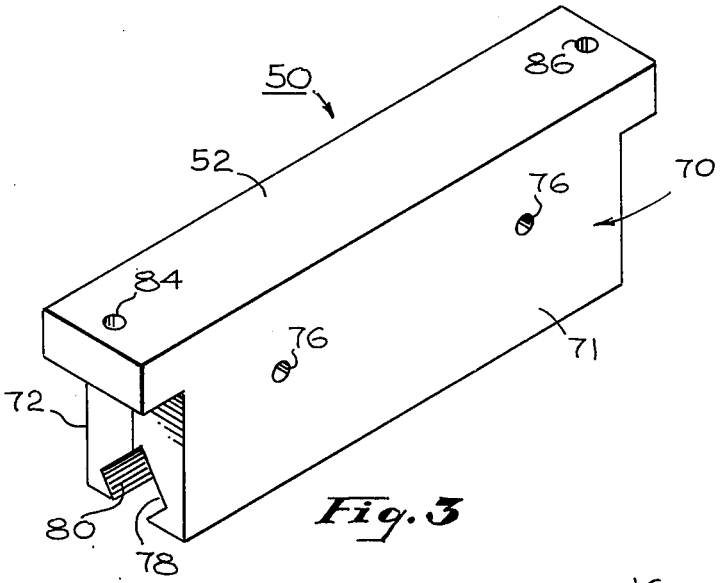
FIG. 3 is a perspective view of a preferred embodiment of the invention.
Figure 4:
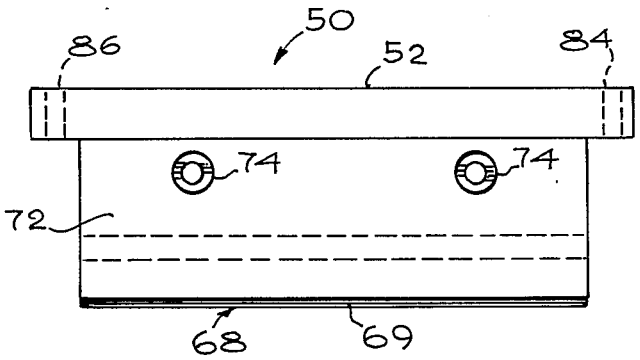
FIG. 4 is a front elevational view of the squeegee holder of FIG. 3 having a wiping element shown.
Figure 5:
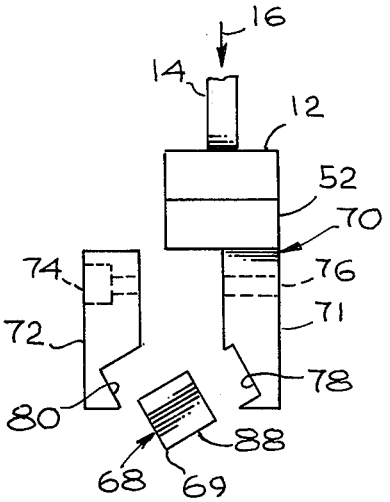
FIG. 5 is a side, exploded elevational view of the squeegee holder of FIG. 4 having a printing apparatus pressure plate shown.

To obviate these disadvantages and the uneven pressure resulting from the prior art structure, a squeegee holder 50 as seen in FIGS. 3, 4 and 5 is provided. In this particular embodiment, a pair of asymmetrical mounting plates 70, 72 are provided for gripping a squeegee 68. A left holding strip or mounting plate 72 is generally slab-shaped and is provided with a jaw 80 and fastener holes 74. A right holding or mounting plate 70 is generally L-shaped and is provided having an asymmetrical squeegee engaging or gripping jaw 78 in the holder portion 71 thereof designed to grip the corner edge of a squeegee 68 having a generally square cross-section. The jaw 78 will engage one full elongated side of the squeegee 68 and portions of the two sides adjacent thereto. The jaw 80 is designed to engage portions only of two of the elongated sides of the squeegee 68, one of these sides being one of those engaged by the jaw 78. In the embodiment illustrated in FIGS. 3 and 5, the configuration of the jaws 78, 80 is such as to provide an angle of attack for the squeegee blade 68 of approximately 30°. In such a case, the diagonal plane through the exposed or wiping corner edge and the opposite corner edge is at an angle of 15° with the vertical junction plane of the mounting plates 70, 72. The same structure but with the jaws 78, 80 configured in a mirror image to that shown in FIGS. 3 and 5 would cant the squeegee blade 68 in the other direction and would provide an angle of attack of approximately 60°. Alternatively, the holder 50 may be reversed end for end in its attachment to the holding plate 12 in order to establish the angle of attack of 30°.

The L-shaped mounting plate 70 includes attaching means such as head plate section portion 52 integrally formed with the holder portion 71. The head plate portion 52 is directly connected to the pressure plate 12 by fasteners such as cylindrical screws through a single pair of holes 84 and 86. The pressure plate 12 is connected by link 14 to a thick film printer which applies pressure in the direction of arrow 16 as detailed above.

The squeegee blade 68 is inserted into the jaw 78 and compressively held therein by the lateral action of jaw 80. Jaw 80 and jaw 78 laterally compress the squeegee 68 by the pressure applied by the fasteners through the holes 74 and 76.

In operation, a thick film printing apparatus applies pressure in the direction of arrow 16 through the links 14 to the pressure plate 12. Because there is only a single head plate portion 52 for the holder 50, all the downward pressure is applied directly to the right holding or mounting plate 70 through the single head plate section 52. The reaction pressure is received in the squeegee 68 from the wiping side 88 and edge 69, and passed directly into the jaws 80 and 78. The reaction force, however, is communicated to the pressure plate 12 only through the unitary right holder portion 71 and head plate section 52, thus avoiding a dual reaction pressure input as found in the prior art seen in FIG. 2. Thus, in the preferred embodiment, there is no reaction force applied in a manner to separate or distort the compression jaws of the pressure plate 12 when the squeegee is held compressibly between the jaws 78 and 80, as there is in the prior art arrangement. The resulting uniform exposed edge of the squeegee 68 delivers a uniform thickness of ink to the substrate or surface. In practice, a uniformity of ±2 microns when the ink is dry has been achieved.

Figure 6:
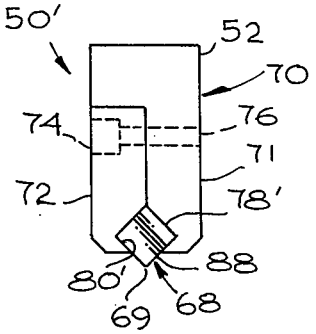
FIG. 6 is a side elevational view of an alternative embodiment of the invention.

As shown representatively in FIG. 6 of the drawings, the diagonal of the squeegee blade 68 can also be made vertical if the holding plate jaws are so constructed. In this arrangement, in which both jaws 78′, 80′ are symmetrical, the leading side 88 of the squeegee is maintained at an angle of 45° to a horizontal screen against which ink is to be pressured. All that is required is a reforming of the jaws 78 and 80 to a new squeegee embracing configuration such as jaws 78′ and 80′. Otherwise, the holder 50′ is identical to the holder 50, having an L-shaped right holding plate 70 with holder portion 71 and head plate 70 integrally formed together. The slab-shaped left holding plate 72 having jaw 80′ is attached to the holder portion 71 of right holding or mounting plate 70 by fasteners through horizontal holes 74 and 76 shown in phantom. As previously described, head plate section or portion 52 is mountable onto a pressure plate, not shown in the embodiment of FIG. 6, to provide a squeegee blade with an angle of attack of 45°.

Although there have been described above specific arrangements of a squeegee holder for constructing the same in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A squeegee holder for use in a thick film printer apparatus comprising:

a wiper element having elongated sides intersection at generally square corners and having a substantially square cross section;

a first mounting plate forming a substantially rectangular recess with a straight horizontal and straight vertical surface, said first mounting plate having a wiper element-gripping jaw portion of generally U-shaped cross section for gripping a first and a second corner of said wiper element and for holding three adjacent sides thereof; and a second mounting plate having a shape to fit the recess of said first mounting plate and having a wiper element gripping jaw portion, said jaw portion of said second mounting plate forming a right-angular recess for gripping two adjacent sides and one corner of said wiper element, whereby the fourth corner of said wiper element remains exposed, a diagonal passing through said exposed corner and the opposite corner forming an angle of approximately 15° with a vertical plane passing between said mounting plates.

* * * * *